US006722348B2

(12) United States Patent
Nagasaki et al.

(10) Patent No.: US 6,722,348 B2
(45) Date of Patent: Apr. 20, 2004

(54) ABNORMALITY DETECTING APPARATUS FOR FUEL VAPOR TREATING SYSTEM AND METHOD FOR CONTROLLING THE APPARATUS

(75) Inventors: Kenji Nagasaki, Nagoya (JP); Masao Kano, Gamagoori (JP); Yasuo Kato, Aichi-ken (JP); Hideki Miyahara, Aichi-ken (JP); Tokiji Ito, Toyota (JP)

(73) Assignees: Toyota Jidosha Kabushiki Kaisha, Toyota (JP); Denso Corporation, Kariya (JP)

( * ) Notice: Subject to any disclaimer, the term of this patent is extended or adjusted under 35 U.S.C. 154(b) by 28 days.

(21) Appl. No.: 10/234,176

(22) Filed: Sep. 5, 2002

(65) Prior Publication Data

US 2003/0074958 A1 Apr. 24, 2003

(30) Foreign Application Priority Data

| | | |
|---|---|---|
| Sep. 7, 2001 | (JP) | 2001-272673 |
| Nov. 20, 2001 | (JP) | 2001-354554 |
| Feb. 19, 2002 | (JP) | 2002-041442 |

(51) Int. Cl.[7] ..... F02M 37/04
(52) U.S. Cl. ..... 123/520; 123/198 D
(58) Field of Search ..... 123/516, 518, 123/519, 520

(56) References Cited

U.S. PATENT DOCUMENTS

| | | | | |
|---|---|---|---|---|
| 5,263,462 A | | 11/1993 | Reddy | |
| 5,383,437 A | * | 1/1995 | Cook et al. | 123/520 |
| 5,829,416 A | * | 11/1998 | Teraoka et al. | 123/520 |
| 5,890,474 A | | 4/1999 | Schnaibel et al. | |

* cited by examiner

*Primary Examiner*—Thomas N. Moulis
(74) *Attorney, Agent, or Firm*—Kenyon & Kenyon

(57) ABSTRACT

When detection of an abnormality in a fuel vapor treating system is executed, a vapor zone including a fuel tank and a canister is sealed. The sealed vapor zone is pressurized. Whether fuel vapor is leaking from the vapor zone is determined based on the pressure in the sealed vapor zone. A canister valve selectively connects a canister with and disconnects the canister from the atmosphere. During the abnormality detecting procedure, an electronic control unit (ECU) shuts the canister valve. After the abnormality detecting procedure is ended, the ECU sends a control signal having a predetermined frequency to the canister valve, thereby gradually increasing the opening size of the canister valve. Accordingly, the pressure in the vapor zone is gradually lowered to the atmospheric pressure. This prevents fuel vapor adsorbed by the canister from being released to the atmosphere.

39 Claims, 15 Drawing Sheets

Fig.15
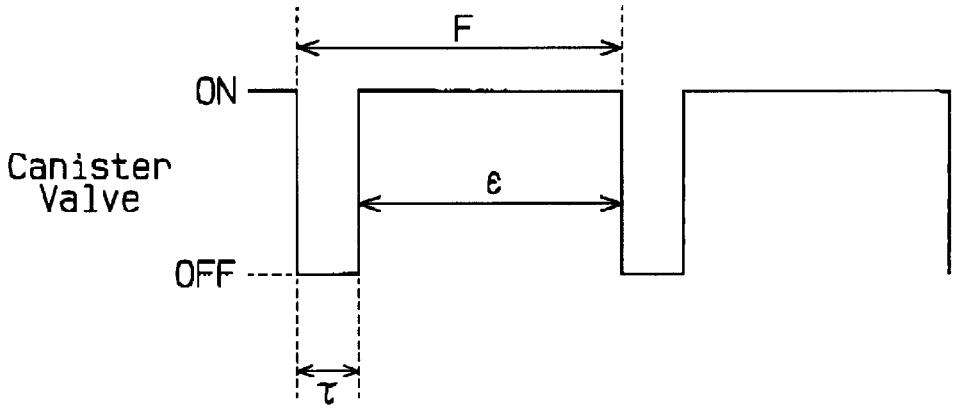
Fig.16(a)
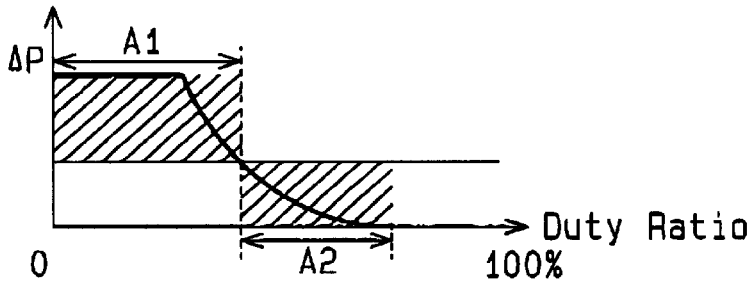
Fig.16(b)
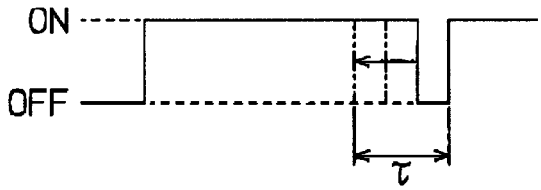
Fig.16(c)
| | |
|---|---|
| τ1 | τ2 |
| ΔP1 | ΔP2 |

ABNORMALITY DETECTING APPARATUS FOR FUEL VAPOR TREATING SYSTEM AND METHOD FOR CONTROLLING THE APPARATUS

BACKGROUND OF THE INVENTION

The present invention relates to an abnormality detecting apparatus for fuel vapor treating system, which adsorbs fuel vapor generated in a fuel tank with a canister and purges the adsorbed fuel vapor to an intake passage of an engine as necessary. The present invention also pertains to a method for controlling the abnormality testing apparatus.

A typical fuel vapor treating system has a canister that contains fuel adsorbent such as granular activated carbon. Fuel vapor generated in the fuel tank of a vehicle is guided to the canister by a vapor passage and is then adsorbed by the adsorbent in the canister. The adsorbed fuel vapor is purged to the intake passage of the engine through a purge line as necessary and is combusted in the engine. A purge control valve is located in the purge line to adjust the flow rate of the fuel vapor purged to the intake passage. The canister is communicated with the atmosphere by an atmosphere passage. A canister valve is located in the atmosphere passage to selectively expose the canister to the atmosphere. When the purge control valve and the canister valve are open, vacuum in the intake passage draws fuel vapor from the canister into the intake passage.

U.S. Pat. No. 5,263,462 discloses an apparatus for detecting abnormalities in a fuel vapor treating system like the one described above. The abnormality detecting apparatus seals a vapor zone including a fuel tank, a vapor passage, a canister, and a purge line, and checks whether fuel vapor is leaking from the vapor zone. Specifically, a purge control valve and a canister valve are closed immediately after the engine is stopped to seal the vapor zone. In this state, the detecting apparatus checks whether fuel vapor is leaking from the vapor zone based on the temperature and the pressure in the vapor zone. For example, if the pressure in the vapor zone sufficiently increases in accordance with an increase of the temperature in the vapor zone, the apparatus judges that fuel vapor is not leaking from the vapor zone. If the pressure in the vapor zone does not sufficiently increase in accordance with an increase of the temperature in the vapor zone, the apparatus judges that fuel vapor is leaking from the vapor zone, or that there is an abnormality in the fuel vapor treating system.

When the abnormality detecting procedure as described above is ended, the canister valve is opened so that the canister is exposed to the atmosphere.

At the time when the abnormality detecting procedure is finished, the pressure in the vapor zone can be higher than the atmospheric pressure. Therefore, when the canister valve is opened after the completion of the abnormality detecting procedure, air is discharged to the atmosphere due to the difference between the pressure in the vapor zone and the atmospheric pressure. The airflow discharges fuel vapor adsorbed by the adsorbent in the canister into the atmosphere.

The above problem is particularly remarkable in the abnormality detecting apparatus disclosed in U.S. Pat. No. 5,890,474. When executing the abnormality detecting procedure, the apparatus pressurizes a sealed vapor zone with a pressurizing pump after an engine is stopped. The apparatus judges whether fuel vapor is leaking from the vapor zone based on the increased pressure in the vapor zone. That is, if the pressure in the vapor zone is lower than a predetermined value despite the increase of the pressure in the sealed vapor zone, the apparatus judges that the fuel vapor is leaking from the vapor zone. In such an abnormality detecting apparatus, which has a pressurizing pump, the difference between the pressure in the vapor zone and the atmospheric pressure when the abnormality detection procedure is finished is greater than that of U.S. Pat. No. 5,263,462. Therefore, when the canister valve is opened after the abnormality detecting procedure is finished, air rushes out to the atmosphere from the canister. The airflow discharges fuel vapor adsorbed by the canister out to the atmosphere.

SUMMARY OF THE INVENTION

Accordingly, it is an objective of the present invention to provide an abnormality detecting apparatus used in a fuel vapor treating system, which apparatus prevents fuel vapor adsorbed by a canister from being discharged to the atmosphere. Another objective of the present invention is to provide a method for controlling the apparatus.

To achieve the foregoing and other objectives and in accordance with the purpose of the present invention, an abnormality detecting apparatus for a fuel vapor treating system is provided. The treating system includes a canister, which adsorbs fuel vapor generated in a fuel tank and purges the adsorbed fuel vapor to an intake passage of an engine. The detecting apparatus performs an abnormality detecting procedure for detecting an abnormality in the treating system. When performing the abnormality detecting procedure, the detecting apparatus seals a vapor zone, which includes the fuel tank and the canister, so that the pressure in the vapor zone exceeds the atmospheric pressure. The detecting apparatus determines whether fuel vapor is leaking from the vapor zone based on the pressure in the sealed vapor zone.

In one aspect of the present invention, the abnormality detecting apparatus includes a valve device and regulating means. The valve device selectively communicates the vapor zone with and disconnects the vapor zone from the atmosphere. During the abnormality detecting procedure, the valve device disconnects the vapor zone from the atmosphere. After the abnormality detecting procedure is ended, the valve device communicates the vapor zone with the atmosphere. When the valve device communicates the vapor zone with the atmosphere, the regulating means regulates a rate at which the pressure in the vapor zone is lowered.

In another aspect of the present invention, the abnormality detecting apparatus includes a canister valve and a controller. The canister valve selectively communicates the canister with and disconnects the canister from the atmosphere. The controller controls the canister valve. During the abnormality detection procedure, the controller shuts the canister valve to disconnect the vapor zone from the atmosphere. After the abnormality detecting procedure is ended, the controller controls the canister valve such that the canister valve communicates the vapor zone with the atmosphere and regulates the rate at which the vapor zone pressure is lowered.

In a further aspect of the present invention, the abnormality detecting apparatus includes a valve device and pressure lowering means. The valve device selectively communicates the vapor zone with and disconnects the vapor zone from the atmosphere. During the abnormality detecting procedure, the valve device disconnects the vapor zone from the atmosphere. After the abnormality detecting procedure is ended, the valve device communicates the vapor zone with the atmosphere. When the valve device communicates the vapor zone with the atmosphere, the pressure lowering means slowly lowers the pressure in the vapor zone to the atmospheric pressure, thereby preventing air released from the vapor zone to the atmosphere from separating fuel vapor from the canister.

The present invention may also be applied to a method for controlling an abnormality detecting apparatus for a fuel vapor treating system. The treating system includes a canister, which adsorbs fuel vapor generated in a fuel tank and purges the adsorbed fuel vapor to an intake passage of an engine. The method includes: sealing a vapor zone, which includes the fuel tank and the canister, so that the pressure in the vapor zone exceeds the atmospheric pressure; determining whether fuel vapor is leaking from the vapor zone based on the pressure in the sealed vapor zone, thereby detecting an abnormality of the treating system; communicating the vapor zone with the atmosphere after the abnormality detecting procedure is ended; and slowly lowering the pressure in the vapor zone to the atmospheric pressure when the vapor zone is communicated with the atmosphere, thereby preventing air released from the vapor zone to the atmosphere from separating fuel vapor from the canister.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 15 is a time chart for explaining control of current supplied to the canister valve;

FIG. 16(*a*) is a graph representing pressure changes in a vapor zone in relation to the duty ratio of a control signal;

FIG. 16(*b*) is a diagram for explaining a learning procedure;

FIG. 16(*c*) is a diagram showing a learning map;

FIG. 20(*b*) is map showing the relationship between the temperature of a canister valve and a correction factor F2;

DETAILED DESCRIPTION OF THE PREFERRED EMBODIMENTS

A first embodiment of the present invention will now be described with reference to FIGS. 1 to 6.

Figure 1:
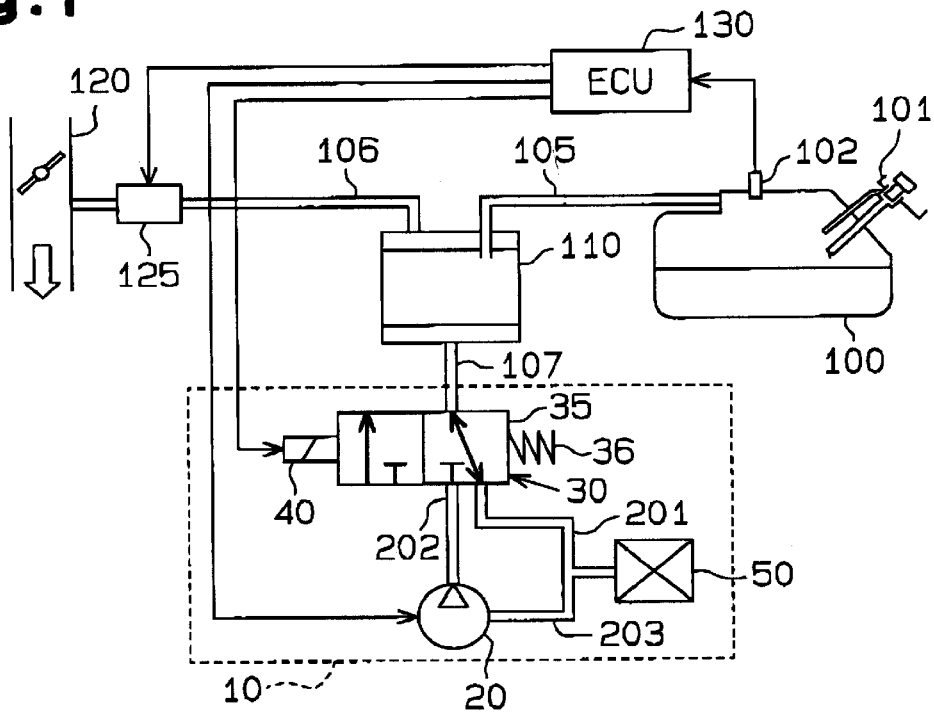
FIG. 1 is a schematic view showing an abnormality detecting apparatus used in a fuel vapor treating system according to a first embodiment of the present invention.

FIG. 1 illustrates a fuel vapor treating system and an abnormality detecting apparatus used in the system. The apparatus includes a pump module 10, a pressure sensor 102, and an electronic control unit (ECU) 130. The apparatus performs tests for detecting leak of fuel vapor from the fuel vapor treating system. The fuel vapor treating system includes a canister 110, a vapor passage 105, and a purge line 106. The canister 110 contains adsorbent such as granular activated carbon. The vapor passage 105 connects a fuel tank 100 of the vehicle to the canister 110. The purge line 106 connects the canister 110 with an intake passage 120 of the engine.

Fuel vapor generated in the fuel tank 100 is guided to the canister 110 by a vapor passage 105 and is then adsorbed by the adsorbent in the canister 110. The adsorbed fuel vapor is purged to the intake passage 120 through the purge line 106 as necessary and is combusted in the combustion chambers of the engine.

The canister 110 is connected to the pump module 10 by a communication passage 107. The fuel tank 100, the canister 110, the vapor passage 105, the purge line 106, and the communication passage 107 form a zone where fuel vapor exists. The zone will hereinafter be referred to a vapor zone. The fuel tank 100 has an fuel inlet 101. The pressure sensor 102 is located in the fuel tank 100 to face the interior of the fuel tank 100. The pressure sensor 102 detects the pressure in the fuel tank 100, or the pressure in the vapor zone. The pressure sensor 102 sends a signal that corresponds to the detected pressure to the ECU 130. As long as the pressure in the vapor zone is detected, the pressure sensor 102 may be located at a position in the vapor zone other than the interior of the fuel tank 100.

The pump module 10 includes a pressurizing device, which is a pump 20 in this embodiment, and an electromagnetic canister valve 30. The canister valve 30 selectively communicates the canister 110 with the pump 20 and the atmosphere. A purge control valve 125 is located in the purge line 106. When the purge control valve 125 is closed, the canister 110 is disconnected from the intake passage 120, When the purge control valve 125 is opened, fuel vapor adsorbed in the adsorbent of the canister 110 is purged to the intake passage 120 through the purge line 106 by the vacuum in the intake passage 120. The purge control valve 125 is an electromagnetic valve. When electricity is not supplied to an electromagnetic actuator of the purge control valve 125, the purge control valve 125 is closed. When electricity is supplied to the electromagnetic actuator, the purge control valve 125 is opened. The purge control valve 125 is duty controlled. The purge control valve 125 adjusts the flow rate of fuel vapor in accordance with the duty ratio of a control signal (voltage signal) supplied to the control valve 125.

The ECU 130, which functions as a controller, includes a central processing unit (CPU), a read only memory (ROM), and an I/O interface. The ECU 130 causes the CPU to execute control programs previously stored in the ROM, thereby controlling the pump 20, the canister valve 30, and the purge control valve 125.

Figure 3:
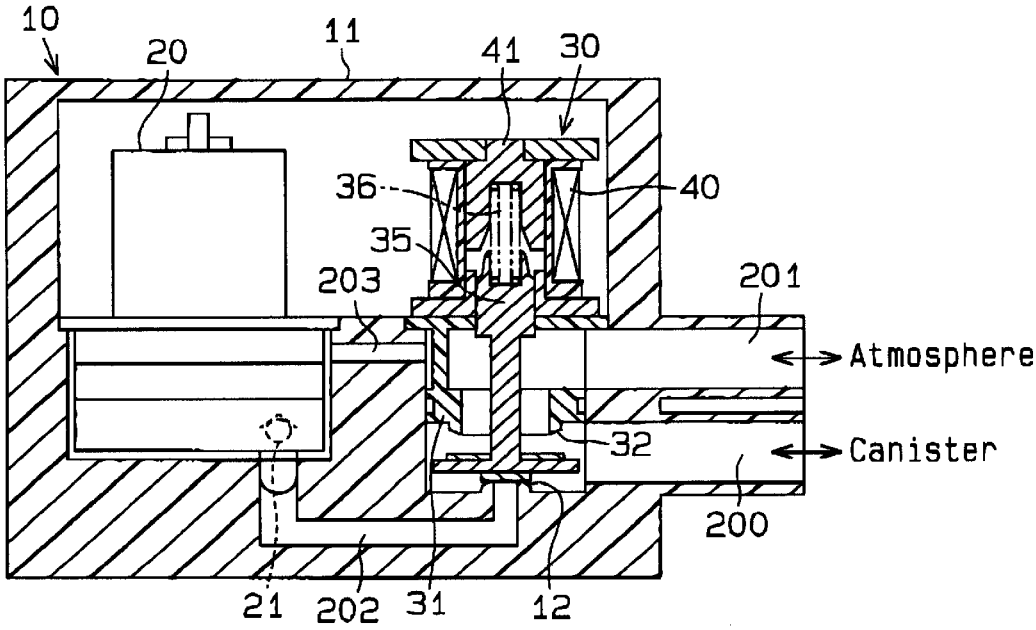
FIG. 3 is a cross-sectional view illustrating the pump module in the apparatus of FIG. 1 when current is not supplied to the canister valve.

The structure of the pump module 10 will now be described. As shown in FIG. 3, the pump module 10 includes a resin housing 11. The housing 11 includes a canister port 200 and an atmosphere port 201. The canister port 200 is connected to the canister 110 by the communication passage 107. The atmosphere port 201 is exposed to the atmosphere through a filter 50 (see FIG. 1).

The pump 20 is located in the housing 11 and is connected to the atmosphere port 201 by an introducing line 203. The atmosphere port 201 is always communicated with the introducing line 203. The pump 20 is also connected to the canister port 200 by an outlet passage 202 formed in the housing 11. The pump 20 draws air from the atmosphere through the filter 50, the atmosphere port 201, and the introducing line 203. The pump 20 supplies the drawn air to the canister 110 through the outlet passage 202, the canister port 200, and the communication passage 107. A check valve 21 is located in the pump 20 to prevent air from flowing back to the introducing line 203 from the outlet passage 202.

Figure 4:
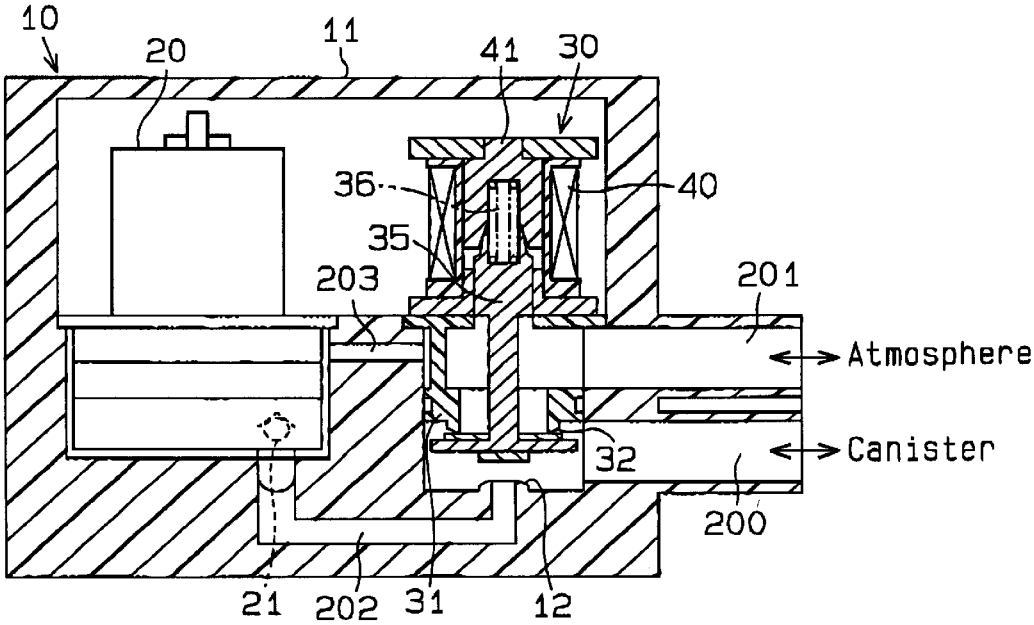
FIG. 4 is a cross-sectional view illustrating the pump module of FIG. 3 when current is supplied to the canister valve.

The housing 11 has a first valve seat 12. The first valve seat 12 is located between the outlet passage 202 and the canister port 200. The canister valve 30, which is located in the housing 11, includes a passage member 31. The passage member 31 communicates the atmosphere port 201 with the canister port 200. A second valve seat 32 is formed in the passage member 31. When a valve member 35 of the canister valve 30 contacts the first valve seat 12 as shown in FIG. 3, the canister port 200 is disconnected from the outlet passage 202 and is communicated with the atmosphere port 201. At this time, the valve member 35 is at a fully open position and exposes the canister 110 to the atmosphere. When a valve member 35 contacts the second valve seat 32 as shown in FIG. 4, the canister port 200 is communicated with the outlet passage 202 and is disconnected from the atmosphere port 201. At this time, the valve member 35 is at a fully closed position and disconnects the canister 110 from the atmosphere.

The canister valve 30 includes a spring 36 to urge the valve member 35 toward the first valve seat 12. The canister valve 30 includes an electromagnetic actuator, which is a coil 40 in this embodiment. When current is not supplied to the coil 40, the force of the spring 36 causes the valve member 35 to contact the first valve seat 12 (see FIG. 3). When current is supplied to the coil 40, the valve member 35 is attached to a stationary core 41 against the force of the spring 36. As a result, the valve member 35 is separated from the first valve seat 12 and contacts the second valve seat 32 (see FIG. 4).

In a normal state, current is not supplied to the pump 20 nor to the canister valve 30 as shown in FIGS. 1 and 3. Also, current is not supplied to the purge control valve 125, and the purge control valve 125 is closed. Accordingly, canister 110 is communicated with the atmosphere through the canister valve 30. Fuel vapor generated in the fuel tank 100 is guided to the canister 110 by a vapor passage 105 and is then adsorbed by the adsorbent in the canister 110.

If current is supplied to the purge control valve 125 in the state shown in FIGS. 1 and 3 to open the purge control valve 125, the intake passage 120 is communicated with the canister 110 through the purge line 106. Since the canister 110 is exposed to the atmosphere, fuel vapor adsorbed in the adsorbent of the canister 110 is purged to the intake passage 120 through the purge line 106 by the vacuum in the intake passage 120.

Figure 2:
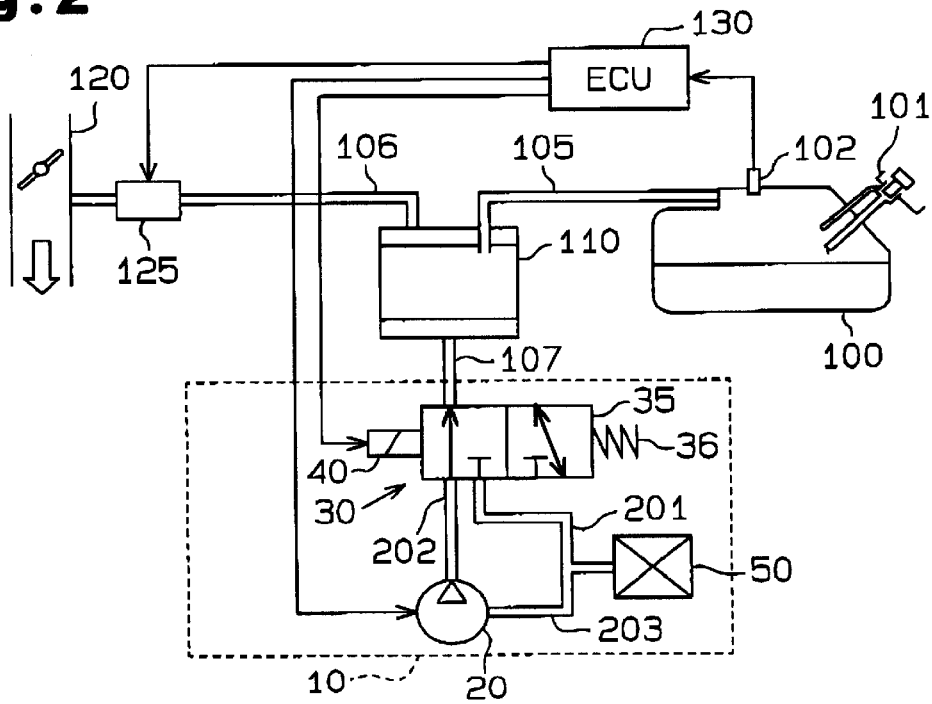
FIG. 2 is a schematic view showing the apparatus of FIG. 1 when the apparatus is executing an abnormality detecting procedure.

When whether fuel vapor is leaking from the vapor zone is checked, that is, when the abnormality detecting procedure is executed, current is supplied to the canister valve 30, and current to the purge control valve 125 is stopped. As a result, the canister valve 30 disconnects the canister 110 from the atmosphere and communicates the canister 110 with the pump 20 as shown in FIGS. 2 and 4. Also, the purge control valve 125 disconnects the canister 110 from the intake passage 120. Therefore, the vapor zone, which includes the fuel tank 100, the canister 110, the vapor passage 105, the purge line 106, and the communication passage 107, is scaled.

In this state, current is supplied to the pump 20. Then, the pump 20 draws air from the atmosphere through the filter 50 and sends the air to the sealed vapor zone, thereby pressurizing the vapor zone. The ECU 130 detects the pressure in the vapor zone based on a signal from the pressure sensor and determines whether the pressure in the vapor zone increases to a predetermined value. If the pressure in the vapor zone reaches the predetermined value, the ECU 130 judges that fuel vapor is not leaking from the vapor zone. If the pressure in the vapor zone does not reach the predetermined value, the ECU 130 judges that fuel vapor is leaking from the vapor zone, and, for example, warns the passenger. The abnormality detecting procedure is executed, for example, immediately after the engine is stopped.

When completing the abnormality detecting procedure, the ECU 130 stops current to the canister valve 30 to communicate the canister 110 with the atmosphere, thereby lowering the pressure in the vapor zone. If current to the canister valve 30 is simply stopped, the force of the airflow from the canister 110 to the atmosphere can separate fuel vapor from the adsorbent of the canister 110 and sends the fuel vapor out to the atmosphere. Particularly, when fuel vapor is not leaking from the vapor zone, the pressure increased during the abnormality detecting procedure increases the difference between the vapor zone pressure and the atmospheric pressure. Accordingly, opening the canister valve 30 is more likely to cause fuel vapor to flow out.

Figure 6:
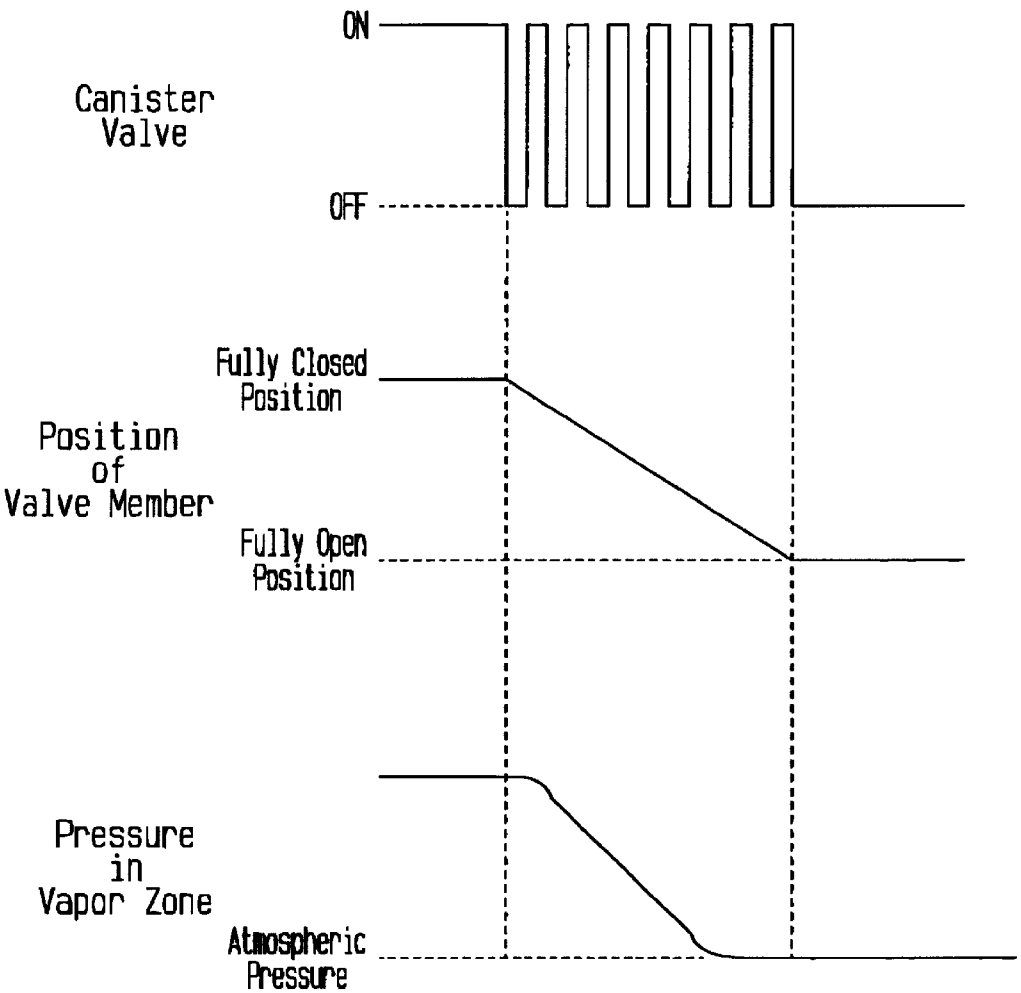
FIG. 6 is a time chart for explaining pressure lowering control executed by the canister valve.

In this embodiment, the ECU 130 controls the canister valve 30 such that the pressure in the canister 110 is gradually lowered when the abnormality detecting procedure is completed (including cases in which the procedure is discontinued). This control is referred to as pressure lowering control of the canister valve 30. Specifically, the ECU 130 controls the frequency of a control signal (a voltage signal) supplied to the coil 40 of the canister valve 30 as shown in FIG. 6, thereby on-off controlling the canister valve 30 at a cycle corresponding to the cycle of the control signal. In other words, current to the canister valve 30 is repeatedly supplied and stopped at predetermined intervals. The on-off control of the canister valve 30 is also referred to as frequency control of the canister valve 30. After executing the on-off control for a predetermined period, the ECU 130 stops supplying current to the canister valve 30.

The frequency of the control signals, or the cycle of the on-off control, is determined such that the valve member 35 of the canister valve 30 cannot follow the on-off control. If the cycle of the on-off control is long, the valve member 35 is moved between the fully closed position and the fully open position at a cycle corresponding to the cycle of the on-off control. However, if the cycle of the on-off control is relatively short, the valve member 35 cannot move at a cycle corresponding to the cycle of the on-off control.

Figure 5:
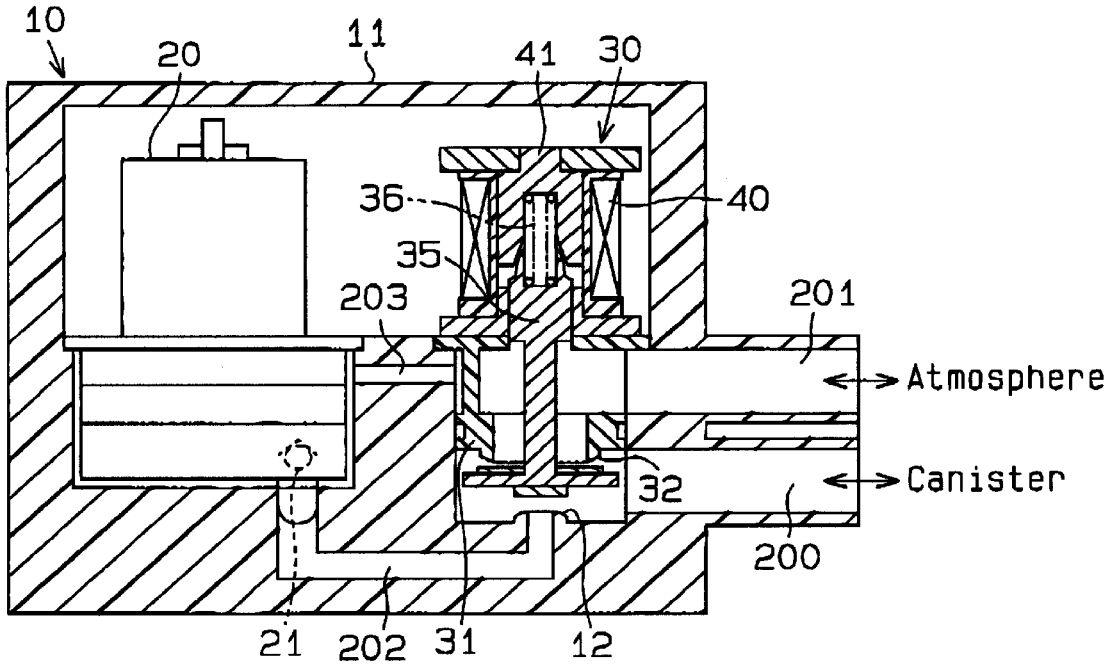
FIG. 5 is a cross-sectional view illustrating the pump module of FIG. 3 when on-off control of the canister valve is being performed.

Thus, the valve member 35, which is urged toward the fully open position by the spring 36, is gradually moved at a constant rate to the fully open position shown in FIG. 3 from the fully closed position shown in FIG. 4 during the on-off control (see FIG. 6). That is, the opening size of the canister valve 30 is gradually increased at a constant rate. FIG. 5 illustrates a state in which the valve member 35 is moving from the fully closed position to the fully open position. Such movement of the valve member 35 gradually increases the cross-sectional area at which the canister 110 is exposed to the atmosphere. Accordingly, the pressure in the vapor zone is gradually lowered to the atmospheric pressure at a constant rate. Air is not released into the atmosphere at a time. Therefore, fuel vapor is prevented from being separated from the adsorbent in the canister 110 and being discharged to the atmosphere.

In stead of executing the on-off control of the canister valve 30 for a predetermined period, the on-off control may be stopped when the vapor zone pressure is lowered to a permissible value, which is higher than the atmospheric pressure, thereby stopping current to the canister valve 30.

Also, if the fuel vapor is judged to be leaking in the abnormality detecting procedure, the pressure lowering control of the canister valve 30 need not be executed. In FIG. 6, the duration of the on periods is equal to the duration of the off periods. However, the duration of the on periods may be different from that of the off periods.

Figure 7:
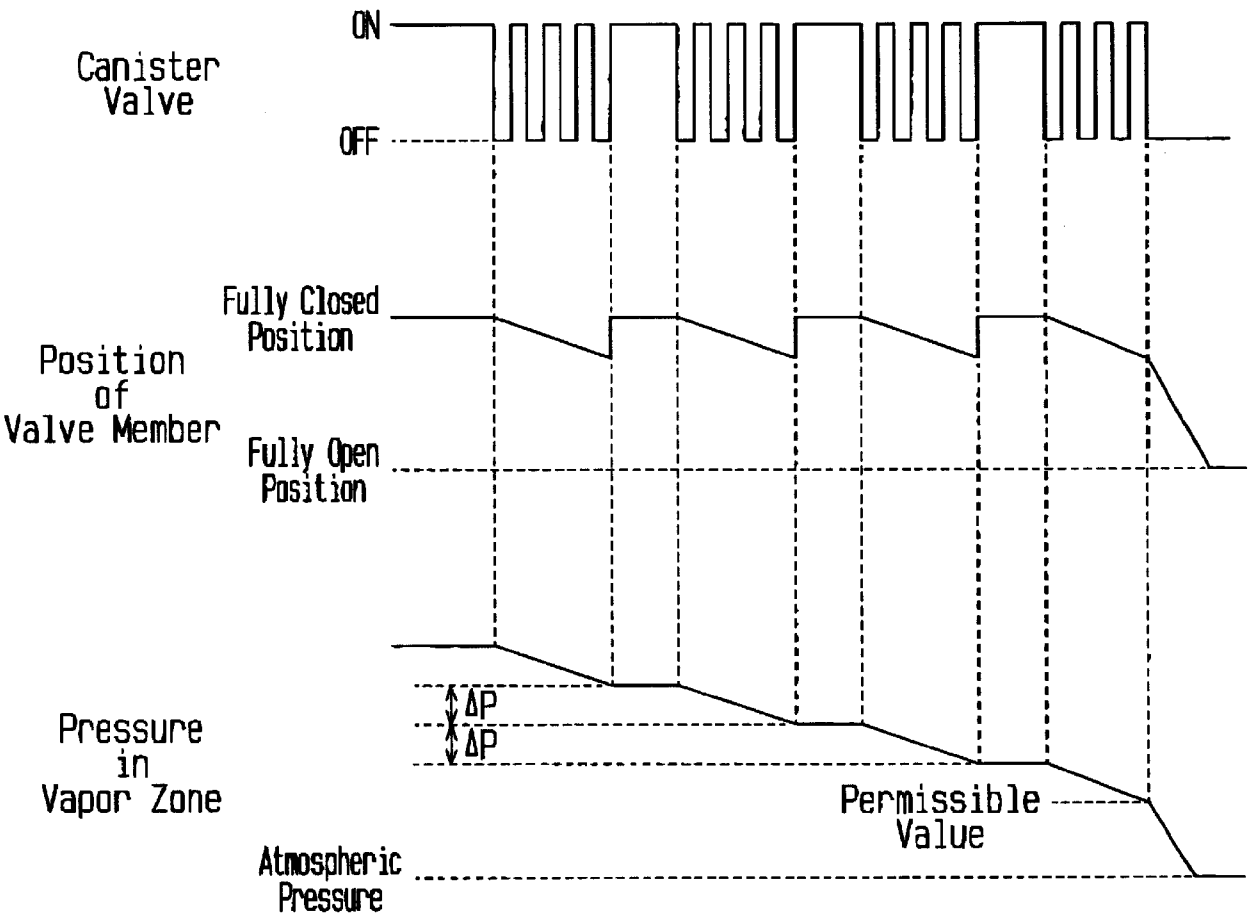
FIG. 7 is a time chart for explaining pressure lowering control executed by a canister valve according to a second embodiment.

FIG. 7 shows a pressure lowering control according to a second embodiment of the present invention. The mechanical structure is the same as that described in FIG. 1.

In the same manner as the on-off control of FIG. 6, the ECU 130 starts on-off control of the canister valve 30 as shown in FIG. 7 when the abnormality detecting procedure is completed. When the pressure in the vapor zone drops by a predetermined amount ΔP, the ECU 130 discontinues the on-off control of the canister valve 30 and starts supplying current to the coil 40. Then, the valve member 35, which is gradually moving from the fully closed position to the fully open position, is returned to the fully closed position. This stops the pressure drop in the vapor zone. When a predetermined period has elapsed, the ECU 130 resumes the on-off control of the canister valve 30 to lower the pressure in the vapor zone by the predetermined amount ΔP. The execution and discontinuation of the on-off control are alternately repeated until the vapor zone pressure is lowered to a predetermined value that is higher than the atmospheric pressure. When the vapor zone pressure drops to a predetermined permissible value, the ECU 130 stops supplying current to the coil 40, thereby lowering the vapor zone pressure to the atmospheric pressure.

As the resistance of the coil 40 changes according to temperature changes, the nature of movement of the valve member 35 during the on-off control is changed. Accordingly, the rate at which the vapor zone pressure is lowered. However, in the pressure lowing control of this embodiment, the execution an discontinuation of the on-off control of the canister valve 30 are repeated. Therefore, even if the rate at which the vapor zone pressure is lowered is increased during the on-off control, the pressure is prevented from being abruptly lowered by a great amount, and the vapor zone pressure is gradually lowered taking relatively long period. Further, in case where the rate at which the vapor zone pressure is lowered varies depending on each apparatus, the vapor zone pressure is lowered at a sufficiently slow rate in every apparatus.

Figure 8:
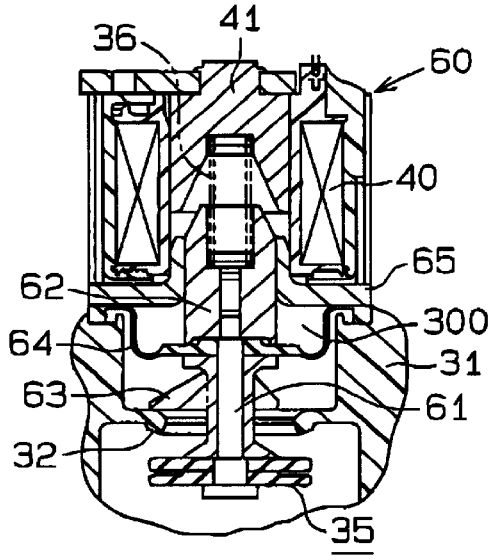
FIG. 8 is a cross-sectional view illustrating a canister valve according to a third embodiment of the present invention.

FIG. 8 illustrates a canister valve 60 according to a third embodiment of the present invention. The structure other than the canister valve 60 is the same as the structure described in FIG. 1. In the canister valve 60 of FIG. 8, like or the same reference numerals are given to those components that are like or the same as the corresponding components of the canister valve 30 shown in FIG. 3. The differences from the canister valve 30 will mainly be discussed below.

As shown in FIG. 8, the valve member 35 of the canister valve 60 has a shaft 61 and a movable core 62. The movable core 62 is secured to the proximal end of the shaft 61. The movable core 62 is slidably supported by a supporting member 65. Like the canister valve 30 shown in FIG. 3, when current is not supplied to the coil 40, the valve member 35 is moved to the fully open position by the force of the spring 36 to expose the canister 110 to the atmosphere. When current is supplied to the coil 40, the valve member 35 is moved to the fully closed position against the force of the spring 36 to disconnect the canister 110 from the atmosphere.

A holder 63 is fitted about the shaft 61. A rubber diaphragm 64 is held between the holder 63 and the movable core 62. The peripheral portion of the diaphragm is held between the passage member 31 and the supporting member 65. A damper chamber 300 is defined between the supporting member 65 and the diaphragm 64. The diaphragm 64 and the damper chamber 300 function as a damper for slowing the movement of the valve member 35.

The abnormality detecting procedure is executed in the same manner as that of the first embodiment shown in FIGS. 1 to 6. During the abnormality detecting procedure, the ECU 130 controls the canister valve 60 to perform pressure lowing control shown in FIG. 6 or 7.

When the current to the canister valve 60 is stopped during the on-off control of the pressure lowering control, the valve member 35 is moved toward the fully open position by the force of the spring 36. At this time, the damper chamber 300 applies resistance to the movement of the valve member 35 to reduce the speed of the valve member 35. As a result, during the on-off control, the speed of the valve member 35 toward the fully open position is reduced compared to a case in which no damper chamber 300 exists. That is, the damper chamber 300 reduces the inclination of a line that represents changes in the position of the valve member 35 in FIG. 6, for example, from the fully closed position to the fully open position. Therefore, compared to a case where the canister valve 30 shown in FIG. 3 is used, the pressure in the vapor zone is lowered at a slower rate.

Since the valve member 35 of the canister valve 60 is moved relatively slowly, the vapor zone pressure is prevented from being abruptly changed. In other words, the vapor zone pressure is controlled in a desirable manner.

FIG. 8 illustrates another embodiment. In the embodiment of FIG. 8, if the damper chamber 300 sufficiently reduces the speed of the valve member 35, the canister valve 60 may be switched from the on state to the off state after the abnormality detecting control without executing the on-off control of the canister valve 60. In this case, the vapor zone pressure is lowered sufficiently slowly. That is, the means for slowly lowering the pressure in the vapor zone of the present invention, in other words, means for adjusting the rate at which the vapor zone pressure is lowered, includes means for electrically controlling the canister valve and means for mechanically controlling the canister valve.

In the embodiments shown in FIGS. 1 to 8, the pump 20 may be connected to the vapor zone without the canister valve 30, 60, to directly send air from the pump 20 to the vapor zone. In this case, the canister valve 30, 60 is used for selectively connecting the canister 110 with and disconnecting the canister 110 from the atmosphere.

A fourth embodiment of the present invention will now be described with reference to FIGS. 9 and 10. The differences from the embodiment of FIGS. 1 to 6 will mainly be discussed.

Figure 9:
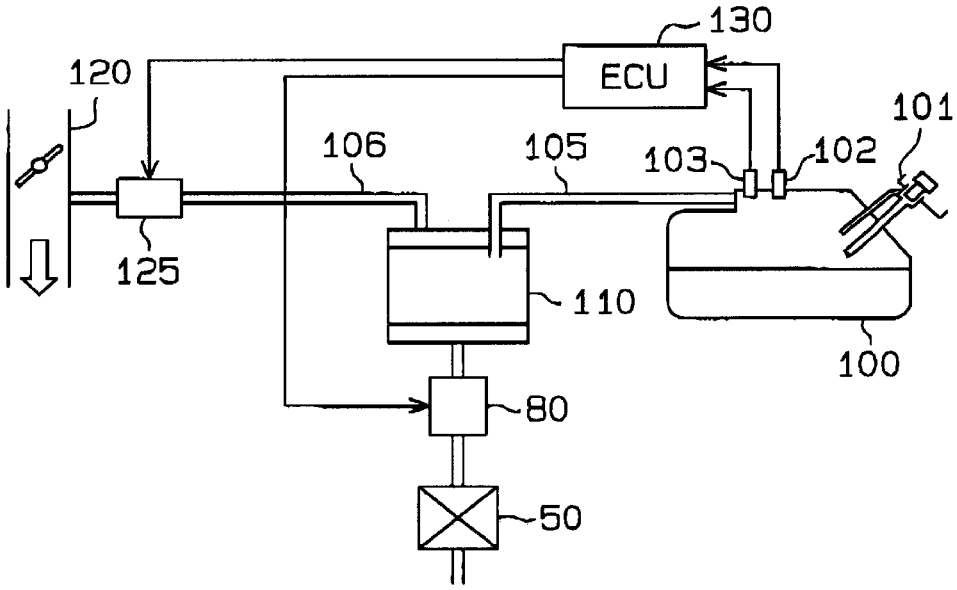
FIG. 9 is a schematic view showing an abnormality detecting apparatus according to a fourth embodiment of the present invention.
Figure 10:
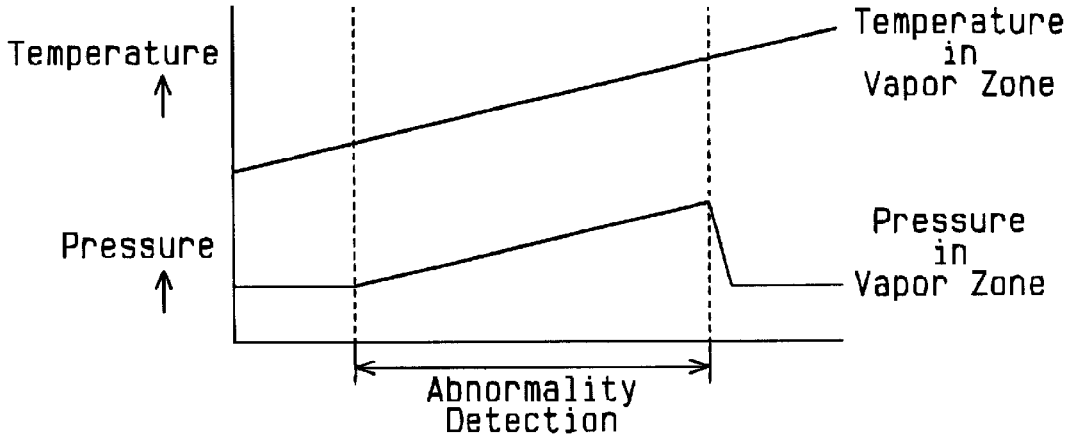
FIG. 10 is a time chart for explaining an abnormality detecting procedure executed by the apparatus of FIG. 9.

As shown in FIG. 9, a temperature sensor 103 is located in the fuel tank 100 in addition to the pressure sensor 102. The temperature sensor 103 detects the temperature in the fuel tank 100, or the temperature in the vapor zone. The temperature sensor 103 sends a signal that corresponds to the detected temperature to the ECU 130. As long as the temperature in the vapor zone is detected, the temperature sensor 103 may be located at a position in the vapor zone other than the interior of the fuel tank 100.

A canister valve 80 is an electromagnetic valve that selectively connects a canister 110 with and disconnects the canister 110 from the atmosphere. When current to the canister valve 80 is stopped, the canister valve 80 is opened to communicate the canister 110 with the atmosphere. When current is sent to the canister valve 80, the canister 110 is disconnected from the atmosphere. In this embodiment, a pump for pressurizing the pressure zone is not provided.

During the abnormality detecting procedure, the canister valve 80 and the purge control valve 125 are shut to seal the vapor zone as the embodiment of FIGS. 1 to 6. If the ambient temperature increases, the temperature in the vapor zone is increased. If fuel vapor is not leaking from the vapor zone, the vapor zone pressure increases in proportion to the increase of the vapor zone temperature as shown in FIG. 10.

The ECU 130 monitors the temperature and the pressure in the vapor zone based on signals from the pressure sensor 102 and the temperature sensor 103 to determine whether fuel vapor is leaking from the vapor zone. After completing the abnormality detecting procedure, the ECU 130 controls the canister valve 80 to perform pressure lowing control shown in FIG. 6 or 7, thereby slowly lowering the vapor zone pressure.

A fifth embodiment of the present invention will now be described with reference to FIGS. 11 and 12. The differences from the embodiment of FIGS. 9 and 10 will mainly be discussed.

Figure 11:
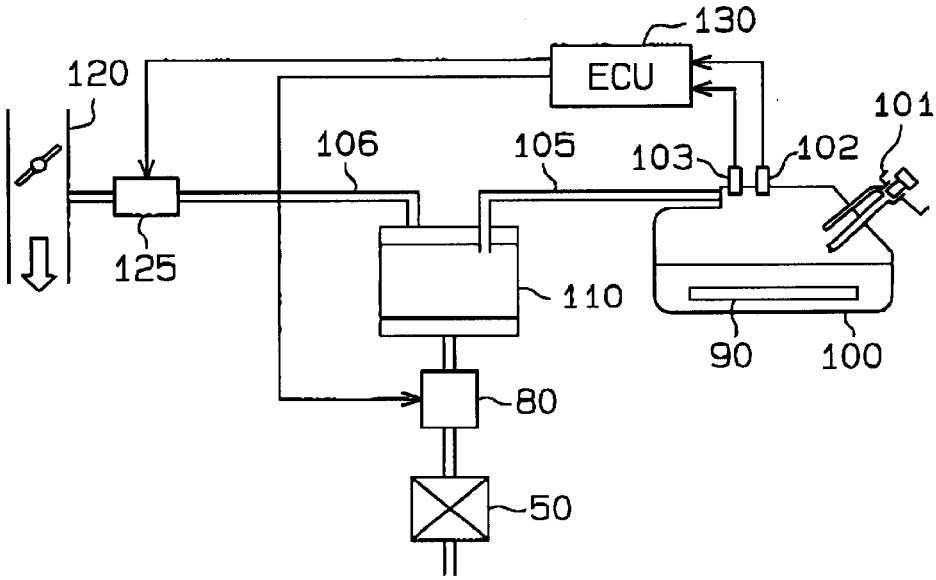
FIG. 11 is a schematic view showing an abnormality detecting apparatus according to a fifth embodiment of the present invention.
Figure 12:
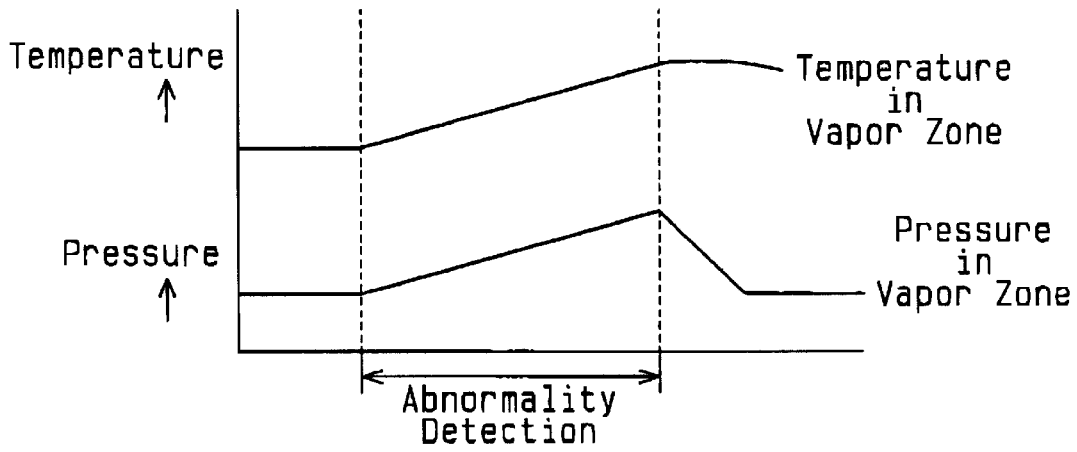
FIG. 12 is a time chart for explaining an abnormality detecting procedure executed by the apparatus of FIG. 11.

As shown in FIG. 11, a heater 90, which functions as a pressurizing device, is provided in the fuel tank 100. The heat 90 is, for example, a self-regulated PTC heater. When abnormality detecting procedure is executed, the PTC heater forcibly heats the interior of the fuel tank 100 as shown in FIG. 12 to increase the temperature in the fuel tank 100, or the temperature of the vapor zone. The vapor pressure increases accordingly. Compared to the embodiment of FIGS. 9 and 10, the temperature and the pressure in the vapor zone increase rapidly, which shortens the time required for the abnormality detecting procedure.

After completing the abnormality detecting procedure, the ECU 130 controls the canister valve 80 to perform pressure lowing control shown in FIG. 6 or 7, thereby slowly lowering the vapor zone pressure.

In the embodiments of FIGS. 9 to 12, the canister valve 80 may have a damper chamber as the damper chamber 300 shown in FIG. 8. In this case, after the abnormality detecting procedure is completed, current to the canister valve 80 may be simply stopped without executing the on-off control of the canister valve 80.

An abnormality detection apparatus according to a sixth embodiment of the present invention will now be described with reference to FIGS. 13 to 18. In the fuel vapor treating system shown in FIG. 13, like or the same reference numerals are given to those components that are like or the same as the corresponding components of the system FIG. 1. The differences from the system of FIG. 1 will mainly be discussed below.

Figure 13:
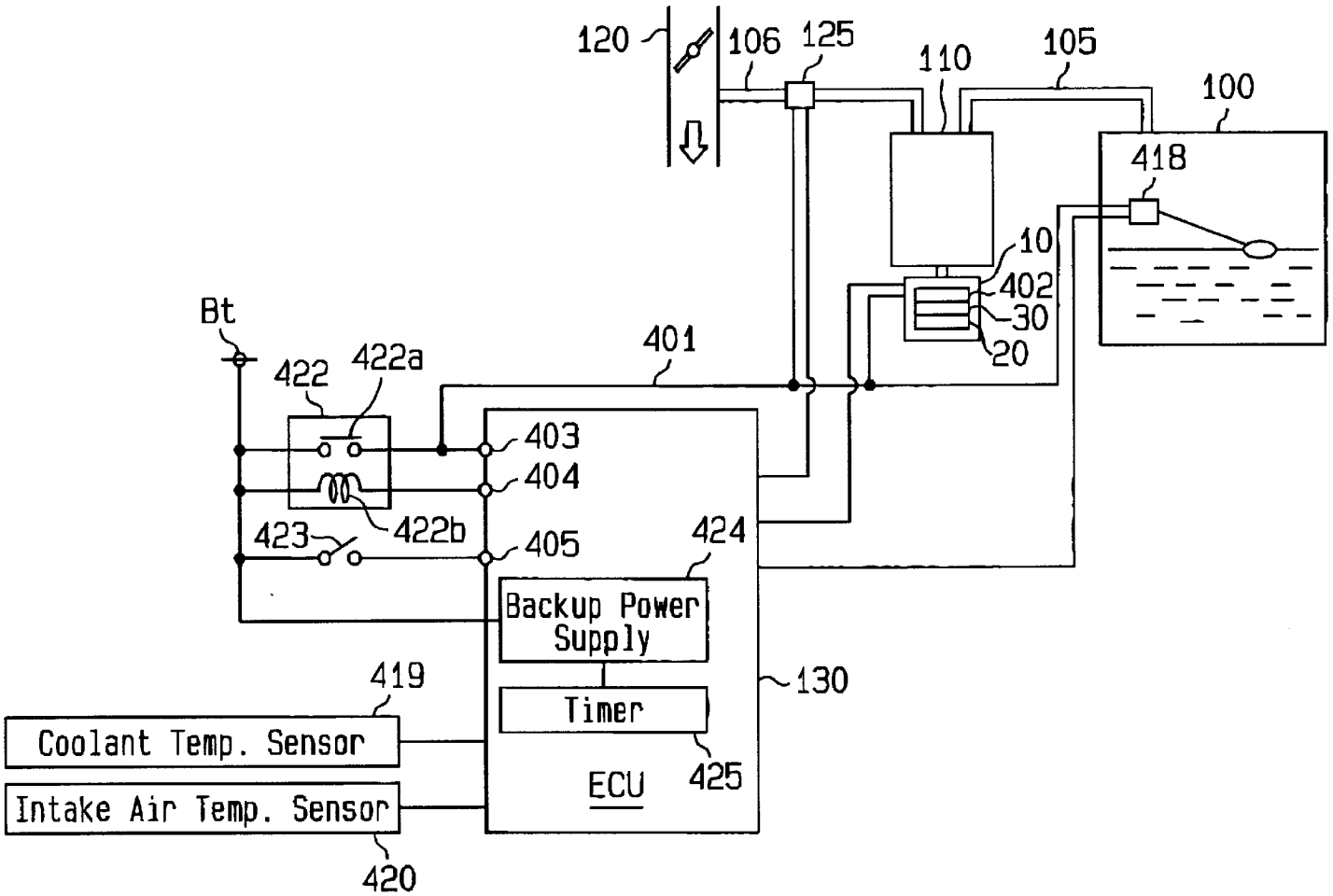
FIG. 13 is a schematic view showing an abnormality detecting apparatus according to a sixth embodiment of the present invention.

As shown in FIG. 13, a pump module 10 is connected to a canister 110. The pump module 10 has a pump 20 and a canister valve 30, which are similar to those of the pump module 10 shown in FIG. 1. The pump module 10 further includes a pressure sensor 402 for detecting the pressure in the vapor zone. The pressure sensor 402 has the same functions as those of the pressure sensor 102 located in the fuel tank 100 shown in FIG. 1. That is, the pump module 10 is equivalent to a module constructed by adding the pressure sensor 402 to the pump module 10 of FIG. 1.

A level sensor 418 is located in the fuel tank 100. The level sensor 418 detects the level of fuel, or the remaining amount of fuel. A coolant temperature sensor 419 and an intake air temperature sensor 420 are connected to the ECU 130. The coolant temperature 419 detects the temperature Thw of the engine coolant, and the intake air temperature sensor 420 detects the temperature of the air in the intake passage 120, or the intake air temperature.

A power supply terminal 403 of the ECU 130 is connected to a vehicle battery Bt through a main relay 422. The battery Bt also applies voltage to the canister valve 30, the pump 20, the pressure sensor 402, the purge control valve 125, and the level sensor 418 by way of the main relay 422 and a feeding line 401 The main relay 422 includes a relay switch 422*a* and a drive coil 422*b* for driving the switch 422*a*. The drive coil 422*b* is connected to a relay control terminal 404 of the ECU 130. When the ECU 130 controls the drive coil 422*b* to close the relay switch 422*a*, voltage of the battery Bt is applied to the devices in the fuel vapor treating system. When the ECU 130 controls the drive coil 422*b* to open the relay switch 422*a*, the supply of the voltage from the battery Bt is discontinued.

The ECU 130 has a key switch terminal 405. The ECU 130 receives an on-off signal from a key switch 423 of the vehicle. The ECU 130 includes a backup power supply 424 and a timer 425, which is driven by the backup power supply 424. When the engine is stopped, or when the key switch 423 is turned off, the timer 425 starts measuring time elapsed after the engine is stopped.

After the key switch 23 is turned off, the ECU 130 determines whether to execute the abnormality detecting procedure based on whether predetermined conditions are satisfied. When the conditions are satisfied, the ECU 130 shuts the purge control valve 125 and the canister valve 30 to start the abnormality detecting procedure, thereby sealing the vapor zone. In this state, the pump 20 pressurizes the vapor zone as described in the embodiment shown in FIGS. 1 to 6, and whether fuel vapor is leaking from the vapor zone is detected. After the abnormality detecting procedure is completed, the ECU 130 executes a pressure lowering control shown in a flowchart of FIG. 14.

Before describing the flowchart of FIG. 14, control of current to the canister valve 30 will be described with reference to a time chart of FIG. 15. In the pressure lowing control of this embodiment, a control signal (voltage signal) supplied to the canister valve 30 is frequency controlled as in the pressure lowering control of FIG. 6 or 7. The canister valve 30 is on-off controlled by a cycle that corresponds to the cycle of the control signal. In FIG. 15, F represents the cycle of the control signal, or the cycle of the on-off control of the canister valve 30. Sign $\epsilon$ represents a period during which current is supplied to the canister valve 30. Sign $\tau$ represents a period during which current is not supplied to the canister valve 30.

The on-off control of this embodiment is different from the on-off control shown in FIG. 6 or 7. That is, the canister valve 30 is duty controlled. In other words, the duty ratio of the control signal (the ratio of the on period $\epsilon$ to the cycle f of the control signal F) supplied to the canister valve 30 is adjusted. The cycle F of the control signal is determined such that the valve member 35 of the canister valve 30 follows the on-off control. That is, the frequency of the control signal is relatively low. Thus, the valve member 35 is located at the closed position during the on period $\epsilon$ and is located at the open position during the off period $\tau$.

Next, a pressure lowering control performed after the abnormality detecting procedure is completed will now be described with reference to the flowchart of FIG. 14. The routine of FIG. 14 is repeated at predetermined time intervals. In step S100, the ECU 130 judges whether a learning completion flag Fstd is one. The learning completion flag Fstd represents whether the property of a pressure change in the vapor zone corresponding to the off period $\tau$ has been learned. If the learning completion flag Fstd is zero, the ECU 130 judges that learning has not been completed and proceeds to step S110. In step S110, the ECU 130 executes a learning procedure. Thereafter, the ECU 130 terminates the routine.

The learning procedure will now be described with reference FIGS. 16(*a*) to 17. FIG. 16(*a*) is a graph representing a pressure change $\Delta P$ in the vapor zone in relation to the duty ratio of the control signal supplied to the canister valve 30. The pressure change $\Delta P$ represents the amount of pressure change during the off period $\tau$ from when the difference between the vapor zone pressure and the atmospheric pressure is a predetermined value. The pressure change $\Delta P$ depends on the variations of measurements of the canister valve 30, which are produced in manufacturing or over time.

As shown in FIG. 16(*a*), the pressure change $\Delta P$ increases as the duty ratio decreases, in other words, as the off period $\tau$ is extended. When the pressure change $\Delta P$ exceeds a threshold value, blowby of air from the canister 110 is likely to occur. In other words, air flow from the canister 110 to the atmosphere is likely to separate fuel vapor from the adsorbent of the canister 110. A region in the off period $\tau$ that corresponds to a region of the pressure change $\Delta P$ greater than the threshold is referred to a non-control region A1. A region in the off period $\tau$ that corresponds to a region of the pressure change $\Delta P$ smaller than the threshold is referred to a control region A2. The pressure change property corresponding to the off period $\tau$ is learned in the control region A2.

Learning of the pressure change property is performed in the following manner. As shown in FIGS. 16(*b*) and 17, the ECU 130 supplies a control signal to the canister valve 30 to perform the on and off control of the canister valve 30. At this time, the ECU 130 initially sets the off period $\tau$ to a relatively small value. Thereafter, the ECU 130 gradually extends the off period $\tau$ until the vapor zone pressure starts changing. The ECU 130 stores the learning value $\tau$ at the time when the pressure changes for the first time as a learning value $\tau 1$. Also, the ECU 130 stores the pressure change $\Delta P$ that corresponds to the learning value $\tau 1$ as a learning value $\Delta P1$. Subsequently, the ECU 130 stores the next off period $\tau$ ($\tau > \tau 1$) and the corresponding pressure change $\Delta P$ as learning values $\tau 2$, $\Delta P2$. As a result, the ECU 130 stores a map shown in FIG. 16(*c*), which contains the two learning values $\tau 1$, $\tau 2$ of the off period $\tau$ and the two learning values $\Delta P1$, $\Delta P2$ of the pressure change $\Delta P$.

Figure 18:
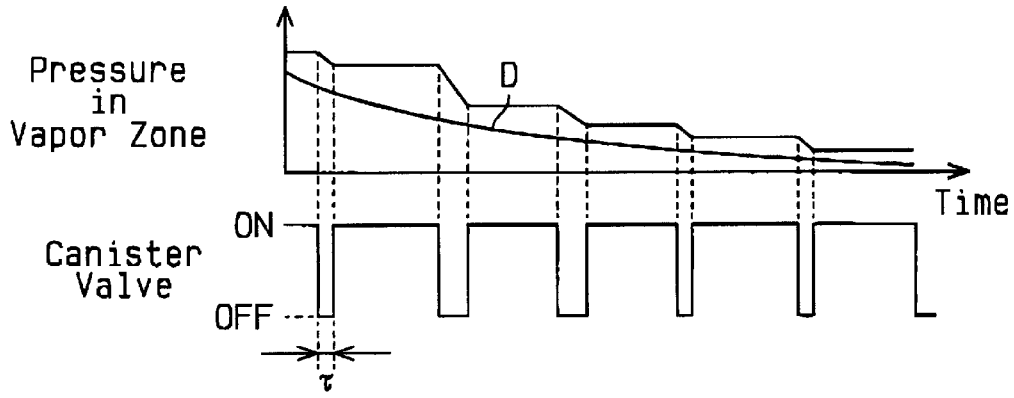
FIG. 18 is a time chart for explaining a pressure lowering control.

After executing the learning procedure in step S110, the ECU 130 sets the learning completion flag Fstd to one and terminates the routine. The learning completion flag Fstd may be cleared to zero when the routine is executed for a predetermined times or when a predetermined period has elapsed. Such periodic executions of the learning procedure permit the pressure change property that corresponds to the off period $\tau$ to be accurately learned On the other hand, if the learning completion flag Fstd is one in step S100, the ECU 130 proceeds to step S120. In step S120, the ECU 130 reads a current target pressure Pp of the vapor zone. The target pressure Pp may be determined based on the vapor zone pressure that was detected in the previous execution of the routine such that the target pressure Pp does not separate fuel vapor from the adsorbent of the canister 110. Alternatively, as shown in FIG. 18, a target pressure profile data D, which represents pressure changes while the vapor zone pressure lowers to the vicinity of the atmospheric pressure, may be set based on the vapor zone pressure at the time when the pressure lowering control is started. The target pressure Pp may be set based on the target pressure profile data D.

In step S130, the ECU 130 detects the vapor zone pressure P based on a signal from the pressure sensor 402. In step S140, the ECU 130 subtracts the target pressure Pp from the vapor zone pressure P to obtain a pressure difference $\Delta Pac$. In step S150, the ECU 130 determines whether the vapor zone pressure P is greater than a predetermined permissible value. If the vapor zone pressure P is equal to or less than the permissible value, the ECU 130 proceeds to step S190. In step 190, the ECU 130 sets the off period $\tau$ to a cycle F of the control signal to the canister valve 30 and terminates the routine. To set the off period $\tau$ to the cycle F eliminates the on period $\epsilon$, and, as a result, current to the canister valve 30 is stopped. That is, if the vapor zone pressure P drops to or below the permissible value, the ECU 130 judges that fuel vapor will not be separated from the adsorbent of the canister 110 even if the canister valve 30 is maintained open.

The ECU 130 therefore opens the canister valve 30 and terminates the routine.

The procedure of step S150 may be replaced by a procedure in which whether a predetermined period has elapsed from when the pressure lowering control was started is judged. In this case, the ECU 130 proceeds to step S190 if the predetermined period has elapsed.

On the other hand, if the vapor zone pressure P is greater than the permissible value in step S150, the ECU 130 proceeds to step S160. In step S160, the ECU 130 judges whether the pressure difference ΔPac is greater than zero. If the pressure difference ΔPac is less than zero, or if the target pressure Pp is less than the vapor zone pressure P, the ECU 130 proceeds to step S180. In step S180, the ECU 130 sets the off period τ and terminates the routine. As a result, current to the canister valve 30 is maintained. That is, if the vapor zone pressure P is less than the target pressure Pp, the canister valve 30 is maintained closed to prevent the vapor zone pressure P from being lowered so that the pressure P approaches the target pressure Pp.

If the pressure difference ΔPac is greater than zero in step S160, the ECU 130 proceeds to step S170. In step S170, the ECU 130 reads a learning value τi (one of the two learning values τ1, τ2) of the off period τ by referring to the learning map shown in FIG. 16(*c*). Then, the ECU 130 multiplies the read learning value τi by a predetermined coefficient Fpi and sets the resultant as the off time τ. The coefficient Fpi is set in accordance with the pressure difference ΔPac. That is, the learning values ΔP1, ΔP2 of the pressure change ΔP are small values that correspond to the control region A2 shown in FIG. 16(*a*). Therefore, the coefficient Fpi is determined in accordance with the pressure difference ΔPac, which is the difference between the vapor zone pressure P an the target pressure Pp, so that the vapor zone pressure P approaches the target pressure Pp. Then, one of the learning values τ1, τ2 is multiplied by the determined coefficient Fpi to obtain the off period τ. When the pressure difference ΔPac is great, the coefficient Fpi is also set to a great value. In this case, the off period τ may be excessively extended so that fuel vapor will be separated from the adsorbent of the canister 110. To avoid this, the upper limit value of the off period τ is previously determined so that the off period τ does not exceed the upper limit value.

FIG. 18 is a time chart for showing a pressure lowering control of this embodiment. When the pressure lowering control is started, a target pressure profile data D is set based on the vapor zone pressure P at the time. Then, the off period τ is set based on the difference ΔPac between the target pressure Pp and the vapor zone pressure P and a learning value τi of the off period τ. The target pressure Pp is determined based on the target pressure profile data D. As a result, the canister valve 30 is on-off controlled, or duty controlled, such that the vapor zone pressure P is slowly lowered while following pressure changes represented by the target pressure profile data D. Therefore, the fuel vapor is prevented from being separated from the adsorbent of the canister 110 and being released to the atmosphere.

The pressure lowering control of this embodiment may be applied to an abnormality detecting apparatus having no pump for pressurizing a vapor zone such as the apparatus of FIGS. 9 to 12.

The frequency of the control signal supplied to the canister valve 30 may be raised to such a level that the valve member 35 of the canister valve 30 cannot follow the on-off control. In this case, the opening of the canister valve 30 is adjusted to correspond to the duty ratio of the control signal.

A seventh embodiment of the present invention will now be described with reference to FIGS. 19 and 20(*b*). The differences from the embodiment of FIGS. 13 to 18 will mainly be discussed. The mechanical structure of the abnormality detecting apparatus is the same as that shown in FIG. 13. Refer to FIG. 13 as necessary.

In this embodiment, the pressure lowering control is executed after the abnormality detecting procedure is completed. In the pressure lowering control, the off period τ is determined such that the vapor zone pressure P is lowered at a constant rate. In this case, if the off period τ is fixed to a predetermined value, the vapor zone pressure P does not necessarily changes at a constant rate. One reason for this is that the time at which the canister valve 30 is closed is delayed from a desired timing as the voltage of the battery B is lowered. That is, as the voltage of the battery Bt is lowered, the drive voltage applied to the canister valve 30 is lowered. This delays the timing at which the canister valve 30 is closed. As a result, the actual period in which the canister valve 30 is opened is excessively extended in relation to the desired off period τ. Another reason is that the resistance of the coil 40 of the canister valve 30 increases as the temperature of the coil 40 increases due to a temperature increase of the canister valve 30. Also in this case, the actual period in which the canister valve 30 is opened is excessively extended in relation to the desired off period τ.

To cope with the problems, the final off period τ is computed in the following manner in this embodiment. A correction factor F1 is set based on the temperature of the canister valve 30. A correction factor F2 is set based on the voltage of the battery Bt. A basic value τbas of the off period τ is multiplied by the correction factors F1 and F2. The resultant is set as the final off period τ. As a result, the canister valve 30 is on-and-off controlled such that the vapor zone pressure P is lowered at a constant rate.

Figure 19:
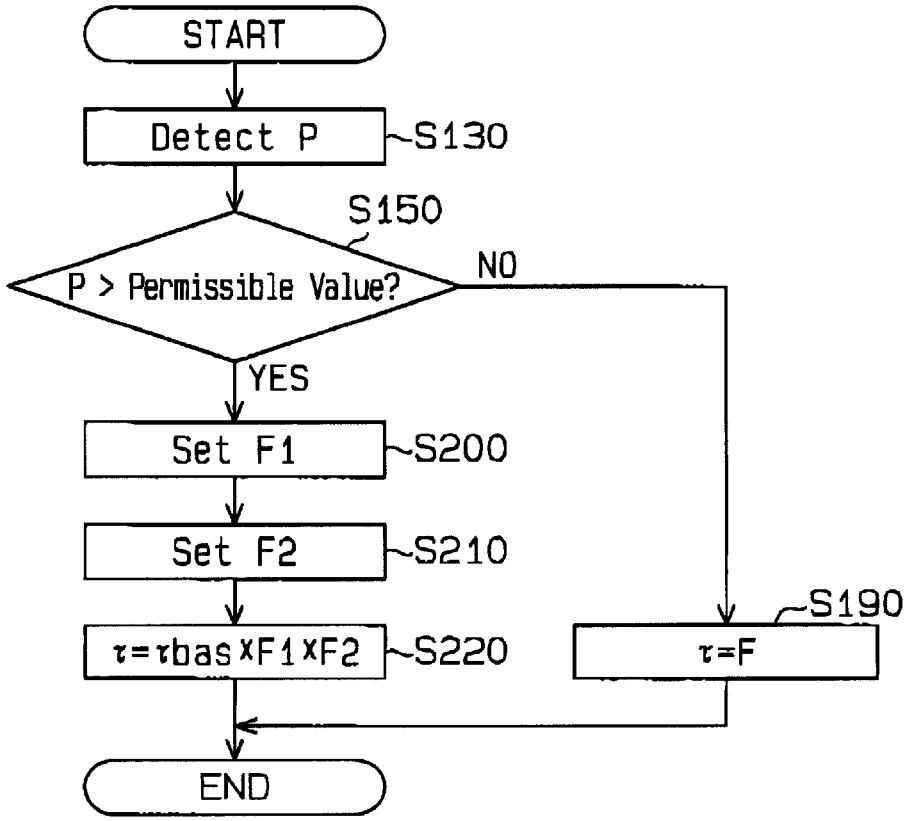
FIG. 19 is a flowchart showing a pressure lowering control according to a seventh embodiment of the present invention.

FIG. 19 is a flowchart showing a pressure lowering control of this embodiment. The same reference numerals are given to those steps that are the same as the corresponding steps in the routine of FIG. 14.

In step S130, the ECU 130 detects the vapor zone pressure P based on a signal from the pressure sensor 402. In step S150, the ECU 130 determines whether the vapor zone pressure P is greater than a permissible value. If the vapor zone pressure P is equal to or less than the permissible value, the ECU 130 proceeds to step S190. In step 190, the ECU 130 sets the off period τ to a cycle F of the control signal to the canister valve 30 and terminates the routine. That is, the ECU 130 stops current to the canister valve 30 and opens the canister valve 30.

If the vapor zone pressure P is greater than a permissible value in step S150, the ECU 130 proceeds to step S200. In step S200, the ECU 130 detects the voltage of the battery Bt and sets the value of a correction factor F1 by referring to the map of FIGS. 20(*a*) based on the detected voltage. The map is previously stored in the ECU 130 as data representing the relationship between the voltage of the battery Bt and the correction factor F1. As shown in the map, the correction factor F1 has a greater value for a greater voltage of the battery Bt and has a smaller value for a smaller voltage of the battery Bt. Since the voltage of the battery Bt reflects the drive voltage of the canister valve 30, the process of step S200 corresponds to a process for setting the correction factor F1 in accordance with an estimated value of the drive voltage of the canister valve 30.

Figure 20A:
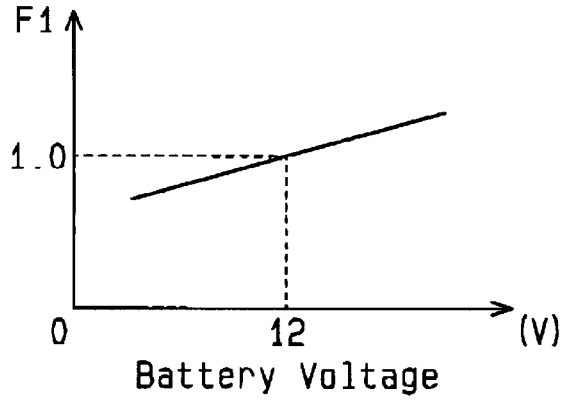
FIG. 20(*a*) is a map showing the relationship between the voltage of a battery and a correction factor F1.
Figure 20B:
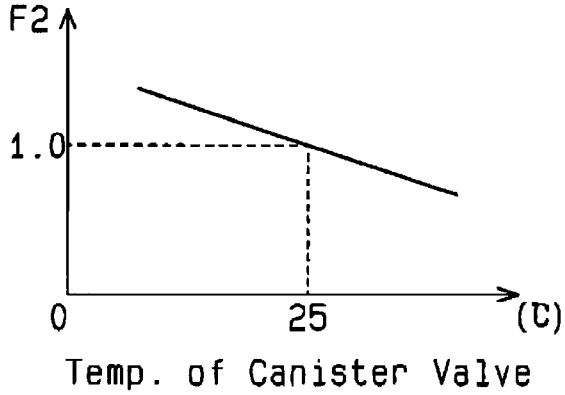

In step S210, the ECU 130 estimates the temperature of the canister valve 30 and sets the correction factor F2 by referring to the map of FIG. 20(*b*) based on the estimated temperature. The temperature of the canister valve 30 is estimated based, for example, on the intake air temperature detected by the intake air temperature sensor 420, the ambient temperature sensor detected by the ambient temperature sensor, the internal temperature of the canister 110 detected by a temperature sensor (not shown), or the internal temperature of the pump module 10. The map of FIG. 20(*b*) is previously stored in the ECU 130 as data representing the relationship between the temperature of the canister valve 30 and the correction factor F2. As shown in the map, the correction factor F2 has a smaller value for a higher temperature of the canister valve 30, and has a greater value for a lower temperature of the canister valve 30.

In step S220, the ECU 130 multiplies a predetermined basic value τbas by the correction factors F1, F2 and sets the resultant as the final off period τ. Then, the ECU 130 terminates the routine.

When the voltage of the battery Bt is lowered, or when the drive voltage of the canister valve 30 is lowered, the correction factor F1 is reduced. Accordingly, the final off period τ is shortened. When the temperature of the canister valve 30 is increased, the correction factor F2 is reduced. Accordingly, the final off period τ is shortened. Therefore, the off period τ is set adequate for the drive voltage and the temperature of the canister valve 30, and the canister valve 30 is on-off controlled such that the vapor zone pressure P is lowered at a constant rate.

Figure 14:
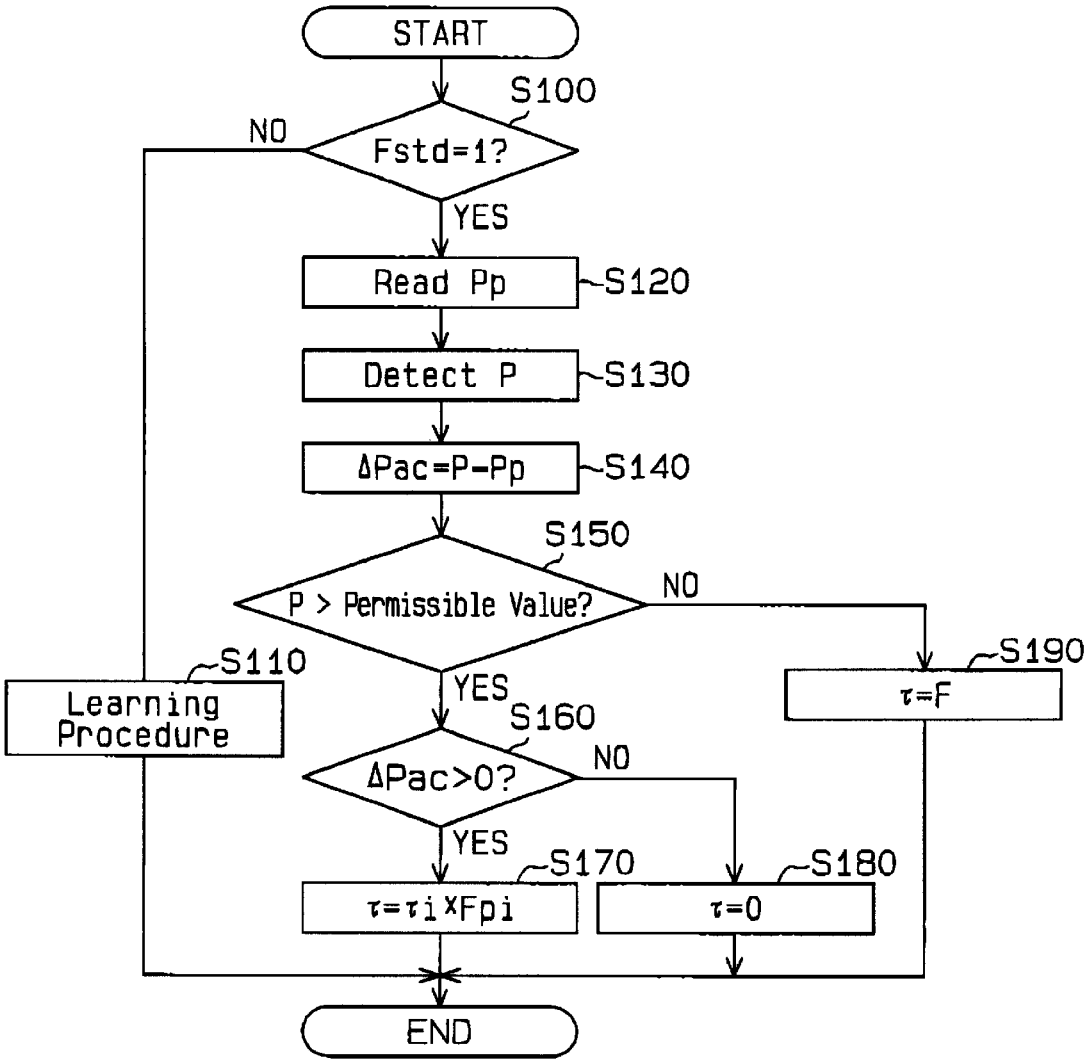
FIG. 14 is a flowchart for showing a pressure lowering control executed by the apparatus of FIG. 13.
Figure 17:
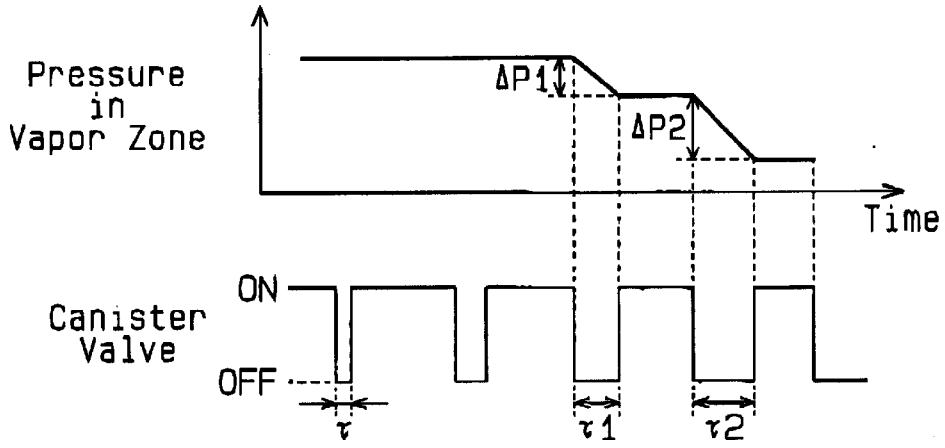
FIG. 17 is a time chart for explaining a learning procedure.

Correction of the off period τ using the correction factors F1, F2 may be applied to the pressure lowering control shown in FIG. 14.

Figure 21:
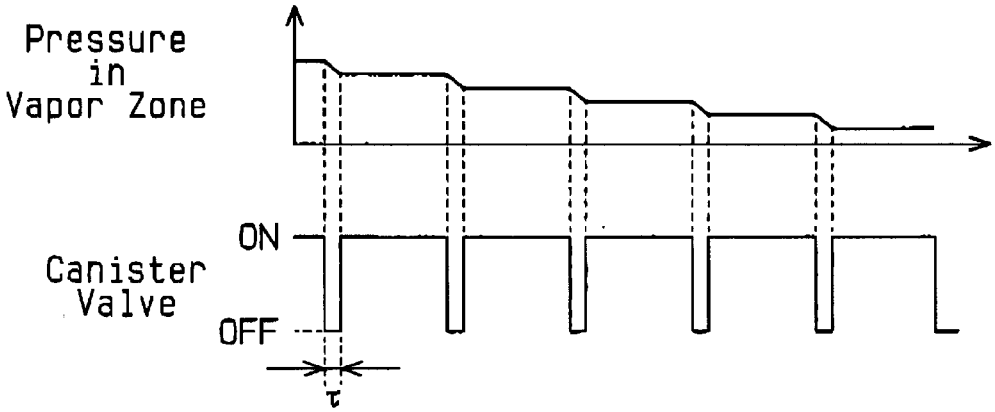
FIG. 21 is a time chart showing a pressure lowering control according to an eighth embodiment of the present invention.

In an eighth embodiment shown in FIG. 21, the off period τ is fixed so that the load of computation applied to the ECU 130 is reduced.

Figure 22:
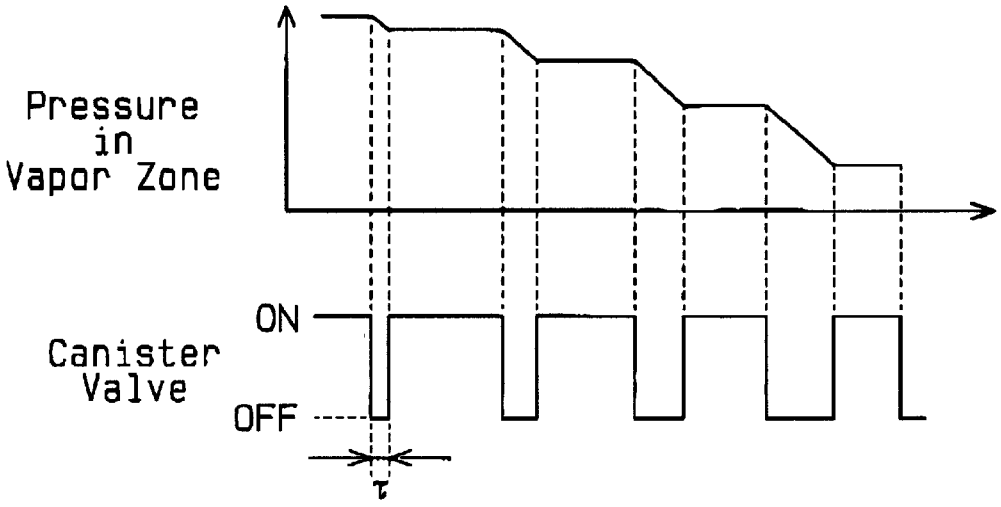
FIG. 22 is a time chart showing a pressure lowering control according to a ninth embodiment of the present invention.

In a ninth embodiment shown in FIG. 22, the off period τ is increased by a predetermined amount at a time.

Means for slowly lowering the vapor zone pressure, or means for adjusting the rate at which the vapor zone pressure is lowered, may be different from the ones described in the above embodiments. For example, the canister valve may be communicated with the atmosphere through a throttle. In this case, simply stopping current to the canister valve after the abnormality detecting procedure is completed, the throttle limits the flow rate of air released to the atmosphere from the vapor zone. The vapor zone pressure is thus lowered slowly.

Therefore, the present examples and embodiments are to be considered as illustrative and not restrictive and the invention is not to be limited to the details given herein, but may be modified within the scope and equivalence of the appended claims.

What is claimed is:

1. An abnormality detecting apparatus for a fuel vapor treating system, wherein the treating system includes a canister, which adsorbs fuel vapor generated in a fuel tank and purges the adsorbed fuel vapor to an intake passage of an engine, wherein the detecting apparatus performs an abnormality detecting procedure for detecting an abnormality in the treating system, wherein, when performing the abnormality detecting procedure, the detecting apparatus seals a vapor zone, which includes the fuel tank and the canister, so that the pressure in the vapor zone exceeds the atmospheric pressure, wherein the detecting apparatus determines whether fuel vapor is leaking from the vapor zone based on the pressure in the sealed vapor zone, the apparatus comprising:

a valve device for selectively communicating the vapor zone with and disconnecting the vapor zone from the atmosphere, wherein, during the abnormality detecting procedure, the valve device disconnects the vapor zone from the atmosphere, and wherein, after the abnormality detecting procedure is ended, the valve device communicates the vapor zone with the atmosphere; and regulating means, wherein, when the valve device communicates the vapor zone with the atmosphere, the regulating means regulates a rate at which the pressure in the vapor zone is lowered.

2. The apparatus according to claim 1, wherein the valve device is an electromagnetic valve having a valve member and an electromagnetic actuator for actuating the valve member.

3. The apparatus according to claim 2, wherein the valve member is moved between an open position for communicating the vapor zone with the atmosphere and a closed position for disconnecting the vapor zone from the atmosphere, wherein the regulating means includes a damper provided in the valve device to slow the movement of the valve member from the closed position to the open position.

4. The apparatus according to claim 2, wherein the regulating means includes an electronic controller, wherein the electronic controller sends a control signal to the electromagnetic actuator to control the movement of the valve member.

5. The apparatus according to claim 4, wherein the valve member is moved between an open position for communicating the vapor zone with the atmosphere and a closed position for disconnecting the vapor zone from the atmosphere, wherein, after the abnormality detecting procedure is ended, the electronic controller executes frequency control of the valve device, wherein, when executing the frequency control, the electronic controller sends the control signal having a predetermined frequency to the electromagnetic actuator, thereby gradually moving the valve member from the closed position to the open position.

6. The apparatus according to claim 5, wherein the electronic controller executes the frequency control such that the valve member is gradually moved from the closed position to the open position at a constant rate.

7. The apparatus according to claim 5, wherein the electronic controller executes the frequency control intermittently with a predetermined pausing period in between, wherein, when the pressure in the vapor zone is lowered by a predetermined value by the frequency control, the electronic controller discontinues the frequency control, and wherein the electronic controller moves the valve member to the closed position during the pausing period.

8. The apparatus according to claim 7, wherein, when the pressure in the vapor zone drops to a predetermined permissible value, which is higher than the atmospheric pressure, the electronic controller ends the frequency control and maintains the valve member at the open position.

9. The apparatus according to claim 4, wherein the valve member is moved between an open position for communicating the vapor zone with the atmosphere and a closed position for disconnecting the vapor zone from the atmosphere, wherein, after the abnormality detecting procedure is ended, the electronic controller sends the control signal having a predetermined frequency to the electromagnetic actuator, thereby moving the valve member between the closed position and the open position at a cycle corresponding to the cycle of the control signal.

10. The apparatus according to claim 9, wherein the electronic controller controls the duty ratio of the control signal to adjust the opening period of the valve device in a single cycle of the control signal.

11. The apparatus according to claim 9, wherein the electronic controller controls the duty ratio of the control signal to adjust the rate at which the pressure in the vapor zone is lowered.

12. The apparatus according to claim 11, wherein the electronic controller sets the duty ratio of the control signal in accordance with at least one of the drive voltage of the valve device and the temperature of the valve device.

13. The apparatus according to claim 11, wherein the electronic controller successively sets a target value of the pressure in the vapor zone as time elapses from when the abnormality detecting procedure is ended, and wherein the electronic controller sets the duty ratio of the control signal based on the current target value and the current pressure in the vapor zone.

14. The apparatus according to claim 1, wherein the valve device is an electromagnetic valve, wherein, when current is not supplied to the valve device, the valve device communicates the vapor zone with the atmosphere, and wherein, when current is supplied to the valve device, the valve device disconnects the vapor zone from the atmosphere.

15. The apparatus according to claim 1, further comprising a pressurizing device, wherein the pressurizing device pressurizes the sealed vapor zone during the abnormality detecting procedure.

16. The apparatus according to claim 15, wherein the pressurizing device includes a pump for sending air to the sealed vapor zone.

17. The apparatus according to claim 16, wherein the valve device is a canister valve, which selectively communicates the canister with and disconnects the canister from the atmosphere, and wherein, when the canister valve disconnects the canister from the atmosphere, the canister valve communicates the canister with the pump.

18. The apparatus according to claim 15, wherein the pressurizing device includes a heater for heating the sealed vapor zone.

19. An abnormality detecting apparatus for a fuel vapor treating system, wherein the treating system includes a canister, which adsorbs fuel vapor generated in a fuel tank and purges the adsorbed fuel vapor to an intake passage of an engine, wherein the detecting apparatus performs an abnormality detecting procedure for detecting an abnormality in the treating system, wherein, when performing the abnormality detecting procedure, the detecting apparatus seals a vapor zone, which includes the fuel tank and the canister, so that the pressure in the vapor zone exceeds the atmospheric pressure, wherein the detecting apparatus determines whether fuel vapor is leaking from the vapor zone based on the pressure in the sealed vapor zone, the apparatus comprising:

a canister valve, which selectively communicates the canister with and disconnects the canister from the atmosphere; and a controller for controlling the canister valve, wherein, during the abnormality detection procedure, the controller shuts the canister valve to disconnects the vapor zone from the atmosphere, wherein, after the abnormality detecting procedure is ended, the controller controls the canister valve such that the canister valve communicates the vapor zone with the atmosphere and regulates the rate at which the vapor zone pressure is lowered.

20. The apparatus according to claim 19, wherein the canister valve is an electromagnetic valve, wherein, after the abnormality detecting procedure is ended, the controller executes frequency control of the canister valve, wherein, when executing the frequency control, the controller sends a control signal having a predetermined frequency to the canister valve, thereby gradually increasing the opening size of the canister valve.

21. The apparatus according to claim 20, wherein the controller executes the frequency control such that the opening size of the canister valve is gradually increased at a constant rate.

22. The apparatus according to claim 20, wherein the controller executes the frequency control intermittently with a predetermined pausing period in between, wherein, when the pressure in the vapor zone is lowered by a predetermined value by the frequency control, the controller discontinues the frequency control, and wherein the controller shuts the canister valve during the pausing period.

23. The apparatus according to claim 22, wherein, when the pressure in the vapor zone drops to a predetermined permissible value, which is higher than the atmospheric pressure, the controller ends the frequency control and fully opens the canister valve.

24. The apparatus according to claim 19, wherein the canister valve is an electromagnetic valve, wherein, after the abnormality detecting procedure is ended, the controller sends a control signal having a predetermined frequency to the canister valve, thereby executing duty ratio control of the canister valve.

25. The apparatus according to claim 24, wherein, when executing the duty ratio control, the controller shuts and opens the canister valve at a cycle corresponding to the cycle of the control signal.

26. The apparatus according to claim 25, wherein the controller controls the duty ratio of the control signal to adjust the opening period of the canister valve in a single cycle of the control signal.

27. The apparatus according to claim 24, wherein the controller controls the duty ratio of the control signal to adjust the rate at which the pressure in the vapor zone is lowered.

28. The apparatus according to claim 27, wherein the controller controls the duty ratio of the control signal to extend the off period in a single cycle of the control signal by a predetermined amount at a time.

29. The apparatus according to claim 27, wherein the controller sets the duty ratio of the control signal in accordance with at least one of the drive voltage of the canister valve and the temperature of the canister valve.

30. The apparatus according to claim 29, wherein the controller detects the voltage of a vehicle battery, which represents the drive voltage of the canister valve.

31. The apparatus according to claim 27, wherein the controller successively sets a target value of the pressure in the vapor zone as time elapses from when the duty ratio control is started, and wherein the controller sets the duty ratio of the control signal based on the current target value and the current pressure in the vapor zone.

32. The apparatus according to claim 31, wherein, based on the pressure in the vapor zone at the time when the duty ratio control is started, the controller previously sets target pressure profile data, the data representing pressure changes until the pressure in the vapor zone is lowered to a vicinity of the atmospheric pressure, and wherein the controller obtains the current target value from the target pressure profile data.

33. The apparatus according to claim 27, wherein, prior to starting the duty ratio control, the controller learns the property of pressure changes in the vapor zone corresponding to the duty ratio of the control signal sent to the canister valve, and wherein the controller sets the duty ratio of the control signal used in the duty ratio control in accordance with the learning result.

34. The apparatus according to claim 24, wherein, when the pressure in the vapor zone drops to a predetermined permissible value, which is higher than the atmospheric pressure, the controller ends the duty ratio control and fully opens the canister valve.

35. The apparatus according to claim 24, wherein, when a predetermined time has elapsed from when the duty ratio control is started, the controller ends the duty ratio control and fully opens the canister valve.

36. The apparatus according to claim 19, further comprising a pressurizing device, wherein the pressurizing device pressurizes the sealed vapor zone during the abnormality detecting procedure.

37. An abnormality detecting apparatus for a fuel vapor treating system, wherein the treating system includes a canister, which adsorbs fuel vapor generated in a fuel tank and purges the adsorbed fuel vapor to an intake passage of an engine, wherein the detecting apparatus performs an abnormality detecting procedure for detecting an abnormality in the treating system, wherein, when performing the abnormality detecting procedure, the detecting apparatus seals a vapor zone, which includes the fuel tank and the canister, so that the pressure in the vapor zone exceeds the atmospheric pressure, wherein the detecting apparatus determines whether fuel vapor is leaking from the vapor zone based on the pressure in the sealed vapor zone, the apparatus comprising:

a valve device for selectively communicating the vapor zone with and disconnecting the vapor zone from the atmosphere, wherein, during the abnormality detecting procedure, the valve device disconnects the vapor zone from the atmosphere, and wherein, after the abnormality detecting procedure is ended, the valve device communicates the vapor zone with the atmosphere; and pressure lowering means, wherein, when the valve device communicates the vapor zone with the atmosphere, the pressure lowering means slowly lowers the pressure in the vapor zone to the atmospheric pressure, thereby preventing air released from the vapor zone to the atmosphere from separating fuel vapor from the canister.

38. A method for controlling an abnormality detecting apparatus for a fuel vapor treating system, wherein the treating system includes a canister, which adsorbs fuel vapor generated in a fuel tank and purges the adsorbed fuel vapor to an intake passage of an engine, the method comprising:

sealing a vapor zone, which includes the fuel tank and the canister, so that the pressure in the vapor zone exceeds the atmospheric pressure;

determining whether fuel vapor is leaking from the vapor zone based on the pressure in the sealed vapor zone, thereby detecting an abnormality of the treating system;

communicating the vapor zone with the atmosphere after the abnormality detecting procedure is ended; and slowly lowering the pressure in the vapor zone to the atmospheric pressure when the vapor zone is communicated with the atmosphere, thereby preventing air released from the vapor zone to the atmosphere from separating fuel vapor from the canister.

39. The method according to claim 38, further comprising pressurizing the sealed vapor zone during the abnormality detecting procedure.

* * * * *